US007086130B2

(12) United States Patent
Jahns et al.

(10) Patent No.: US 7,086,130 B2
(45) Date of Patent: Aug. 8, 2006

(54) APPARATUS AND METHOD FOR TEXTURING A PLURALITY OF BLENDED SYNTHETIC MULTIFILAMENT YARNS

(75) Inventors: Hans-Jürgen Jahns, Neumünster (DE); Bernd Kirchhoff, Neumünster (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 11/188,362

(22) Filed: Jul. 25, 2005

(65) Prior Publication Data

US 2006/0010667 A1 Jan. 19, 2006

Related U.S. Application Data

(63) Continuation of application No. PCT/EP2004/000512, filed on Jan. 22, 2004.

(30) Foreign Application Priority Data

Jan. 24, 2003 (DE) ..... 103 02 762

(51) Int. Cl.
*D02G 1/20* (2006.01)

(52) U.S. Cl. ..... 28/258; 28/220; 28/221

(58) Field of Classification Search ..... 28/258, 28/220, 221, 240, 247, 271, 184, 190–195, 28/198, 201, 214, 253, 245, 208, 219, 248; 242/615, 157.1; 57/333, 350, 351, 90, 91, 57/352; 226/158, 162; 264/103, 211.12, 264/211.14, 211.18, 177.17, 211.15
See application file for complete search history.

(56) References Cited

U.S. PATENT DOCUMENTS 1,898,085 A * 2/1933 Dreyfus et al. ..... 28/243
3,899,562 A 8/1975 Seidl
4,774,042 A * 9/1988 Schippers ..... 264/103
5,317,791 A * 6/1994 Adam ..... 28/252
5,400,486 A 3/1995 Dobbins et al.
5,661,880 A * 9/1997 Schippers et al. ..... 28/240
5,839,678 A * 11/1998 Huey et al. ..... 28/253
5,887,323 A 3/1999 Beifuss et al.
5,928,579 A * 7/1999 Spahlinger et al. ..... 28/220
6,076,345 A 6/2000 Weiss et al.
6,120,715 A * 9/2000 Weigend ..... 28/271
6,397,444 B1 * 6/2002 Foster et al. ..... 28/271
6,406,650 B1 * 6/2002 Gross et al. ..... 28/247

FOREIGN PATENT DOCUMENTS

DE 42 02 896 C2 8/1992
DE 197 46 878 A1 5/1998

(Continued)

*Primary Examiner*—Amy B. Vanatta

(74) *Attorney, Agent, or Firm*—Alston & Bird LLP

(57) ABSTRACT

An apparatus and a method for texturing blended synthetic multifilament yarns, wherein the blended yarns are each produced in parallel from a plurality of individual yarn components. The individual yarn components are withdrawn and drawn by a withdrawal means, with a guide means being associated to the withdrawal means for combining the individual yarns to the blended yarns. The blended yarns are separately textured, and to obtain for each of the blended yarns a combination of the individual yarn components that is as identical as possible, the individual yarn components are divided into groups, with each group being reciprocated by one of a plurality of individually controlled traversing yarn guides. The groups of the individual yarn components are guided independently of one another while being reciprocated, with each of the individual yarn components per group being respectively associated to the blended yarns.

14 Claims, 2 Drawing Sheets

FOREIGN PATENT DOCUMENTS

| | | |
|---|---|---|
| EP | 0 133 198 B1 | 2/1985 |
| EP | 0 485 871 B1 | 5/1992 |
| EP | 0 557 765 B1 | 9/1993 |
| JP | 05247715 | 9/1993 |

* cited by examiner

APPARATUS AND METHOD FOR TEXTURING A PLURALITY OF BLENDED SYNTHETIC MULTIFILAMENT YARNS

CROSS REFERENCE TO RELATED APPLICATION

The present application is a continuation of international application PCT/EP2004/000512, filed 22 Jan., 2004, and which designates the U.S. The disclosure of the referenced application is incorporated herein by reference.

BACKGROUND OF THE INVENTION

The invention relates to an apparatus for texturing a plurality of blended synthetic multifilament yarns, as well as a method for texturing a plurality of blended synthetic multifilament yarns. A generic apparatus and method of this general type are disclosed in DE 197 46 878 A1.

In the known apparatus and method, the blended yarns are formed by combining and subsequently texturing a plurality of individual yarns. In this connection, it is desired that each blended yarn formed from the individual yarns has as much as possible identical properties and an identical appearance after its production. In the known apparatus, the arrangement of the withdrawal means, guide means, and texturing means already results in that the individual yarns advance relative to one another differently to form the individual blended yarns, so that production of identical blended yarns requires special measures.

To form a single blended yarn from a plurality of individual yarns, a plurality of different apparatus and methods are known in the art. For example, EP 0 485 871 A1 discloses a variant, wherein the individual yarns are entangled separately from one another by additional means before being combined to a blended yarn.

DE 42 02 896 A1 discloses a further method, wherein a false twist is imparted to the individual yarns, before they are combined to the blended yarn.

In the apparatus and method disclosed in EP 0 133 198, the individual yarns are constantly changed in their position relative to one another, so as to be again mingled to a blended yarn before advancing into the texturing means. To this end, some of the individual yarns associated to the blended yarn are reciprocated at short strokes.

Likewise, EP 0 557 765 A1 proposes a method and an apparatus, wherein the individual yarns are combined to the blended yarn by changing their relative positions before entering the texturing means.

Common to all apparatus and methods of the art for producing a blended yarn is that the combination of the individual yarns is intended to attain a defined appearance and look of the blended yarn after texturing. However, they are unable to solve the problems arising from the production of a plurality of blended yarns in parallel side-by-side relationship. A multiplication of apparatus components based on the known solutions for a blended yarn leads only to costly equipment in terms of regulation and control for maintaining decisive parameters for the individual production within at least narrow limits, when producing a plurality of blended yarns.

It is therefore an object of the invention to further develop an apparatus and method of the general type described above and which achieves in a parallel production a plurality of synthetic blended yarns a high uniformity in the physical and visual properties of the blended yarns.

SUMMARY OF THE INVENTION

The invention distinguishes itself in that the advance of the individual yarn components for each blended yarn formed by them is totally identical. This precludes a different blending when combining the individual yarn components. To this end, the apparatus of the invention comprises a guide means composed of a plurality of groups of traversing yarn guides. Each group of traversing yarn guides is adapted to be driven for oscillating movement independently of adjacent groups of traversing yarn guides. In this arrangement, one of the traversing yarn guides of each group is associated to one of the individual yarn components, with the one of the individual yarn components being associated respectively to the blended yarns. Thus, the individual yarn components associated to each group of traversing yarn guides are synchronously reciprocated. Since each of the individual yarn components per group of yarn guides is respectively associated to one of the blended yarns, the individual yarn components are reciprocated and combined to the blended yarns substantially in an identical manner.

With the use of multicolor individual yarn components, the further development of the invention provides that the individual yarn components associated with each group of traversing yarn guides have the same properties. With that, it is possible to produce in each of the individual blended yarns the same mixed colors, which result in a streakfree appearance in particular when being further processed to flat structures, such as, for example, carpets.

To be able to adjust as much as possible different mixed colors by changing the reciprocal movement, it is preferred that a separate linear drive be associated to each group of traversing yarn guides, which moves the group of traversing yarn guides synchronously. Also, the linear drives associated to the groups of traversing yarn guides are controllable independently of one another. To this end, the linear drives connect to a control device, which comprises an input unit for entering desired value adjustments of speed, path, and time. With that, it is possible to predetermine and control stroke lengths, or strokes per unit time, or interference pulses for each group of traversing yarn guides individually. This results in a great flexibility in the production of certain blended yarns.

A synchronous drive of the traversing yarn guides of a group is easy to realize in that all traversing yarn guides are mounted on a guide rod in substantially constant spaced relationship. The guide rod is associated to the linear drive and is reciprocated with the traversing yarn guides mounted thereon.

The groups of traversing yarn guides normally precede the withdrawal means, and the withdrawal means is preferably formed by a plurality of godets. With that, it is possible and advantageous to shorten the yarn contacting length of the godets on the one hand, and to thus achieve a uniform drawing of all blended yarns on the other hand.

To this end, the groups of traversing yarn guides are arranged in the direction of the advancing yarn components, in particular one following the other at short distances such that the free length of the individual yarn components formed between the traversing yarn guides and the godets, is the same. With that, it is possible to prevent mutual interference of the reciprocal movement upon contact with the godet circumference.

A particularly advantageous further development of the invention provides for replacing the traversing yarn guides of at least one group of traversing yarn guides with a plurality of entanglement nozzles, so that it is easy to attain additional effects in the production of blended yarns.

For texturing the blended yarns, the texturing means comprises preferably a plurality of feed nozzles with interacting stuffer box chambers. Each of the blended yarns is textured by one of the feed nozzles and stuffer box chambers.

BRIEF DESCRIPTION OF THE DRAWINGS

In the following, the apparatus and method of the invention are described by means of several embodiments with reference to the attached drawings, in which.

DETAILED DESCRIPTION OF THE PREFERRED EMBODIMENTS

Figure 1:
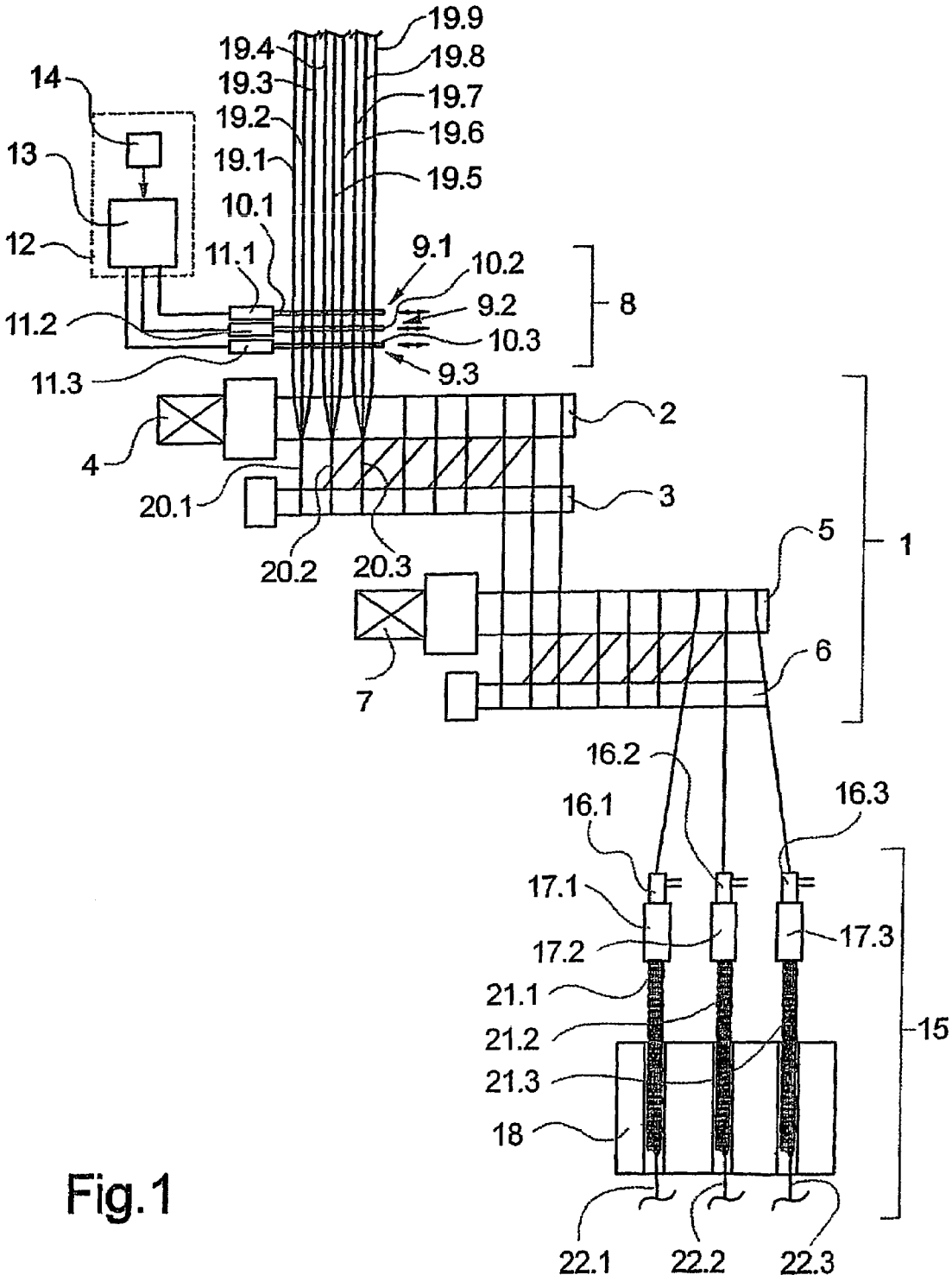
FIG. 1 is a schematic view of the apparatus according to the invention.

FIG. 1 schematically illustrates a first embodiment of an apparatus according to the invention for producing a plurality of blended yarns. The embodiment comprises a withdrawal means 1, a guide means 8 upstream of the withdrawal means, when viewed in the path of the advancing yarns, and a texturing means 15 downstream of the withdrawal means 1. The withdrawal means 1 comprises a withdrawal godet 2 and a draw godet 5, which are each driven independently of each other by godet drives 4 and 7 at a predetermined circumferential speed. Associated to the withdrawal godet 2 is a guide roll 3 and to the draw godet 5 a guide roll 6.

In the direction of the advancing yarns, the guide means 8 precedes the withdrawal godet 2. The guide means 8 comprises three groups of traversing yarn guides, which are identified by numerals 9.1–9.3. The traversing yarn guides of the first group 9.1 are jointly mounted on a guide rod 10.1. The traversing yarn guides of the group 9.2 are arranged on a further guide rod 10.2, and the traversing yarn guides of the group 9.3 on a third guide rod 10.3. Associated to each of the guide rods 10.1–10.3 is respectively one of linear drives 11.1–11.3, which reciprocate the guide rods 10.1–10.3 at short strokes in the direction transverse of the advancing yarns. To control the linear drives 11.1–11.3 a control device 12 is provided. The control device 12 includes a controller 13 and an input unit 14 connected to the controller 13.

Arranged downstream of the withdrawal means 1 is a texturing means 15. The texturing means 15 comprises a total of three texturing nozzles 16.1–16.3, which each interact directly with a stuffer box chamber 17.1–17.3. Downstream of the stuffer box chambers 17.1–17.3 is a cooling device 18. The cooling device 18 is formed, for example, by a rotating cooling drum or a moving cooling belt.

The embodiment shown in FIG. 1 is thus suited to produce three blended yarns in a parallel side-by-side relationship. The number of the blended yarns is exemplary. Likewise, the number of the individual yarn components that form each blended yarn is exemplary. As shown in FIG. 1, a total of nine individual yarn components 19.1–19.9 are withdrawn in parallel by the withdrawal godet 2 from a yarn feed arrangement (not shown). The yarn feed arrangement could be formed, for example, by a spin unit, in which the individual yarns are each extruded from a plurality of filament strands and combined. However, it is also possible that the yarn feed arrangement is defined by a feed yarn creel, which supplies the individual yarns from feed yarn packages.

Before advancing onto the withdrawal godet 2, the individual yarn components 19.1–19.9 are guided by the guide means 8. To each of the yarn components 19.1–19.9, respectively, one yarn guide of one of the groups 9.1–9.3 is associated. Thus, the individual yarn components 19.1, 19.4, and 19.7 are guided by the traversing yarn guides of the first group 9.1. The individual yarn components 19.2, 19.5, and 19.8 are guided by the traversing yarn guides of the group 9.2, and the individual yarn components 19.3, 19.6, and 19.9 are guided by the traversing yarn guides of the group 9.3. With that, the individual yarn components 19.1, 19.4, and 19.7 represent one group of individual yarn components. Likewise, the individual yarn components 19.2, 19.5, and 19.8 form another group of individual yarn components, and the individual yarn components 19.3, 19.6, and 19.9 form a yet further group of individual yarn components.

In the production of multicolor blended yarns, it is preferred to form the groups of individual yarn components by individual yarn components of the same color. Thus, for example, red dyed individual yarn components advance through the first group of traversing yarn guides 9.1. Accordingly, for example, the further groups of individual yarn components could have a different coloration or no coloration. Subsequently, the individual yarn components 19.1–19.9 are reciprocated by the linear drives 11.1–11.3 in short strokes linearly and transversely to the direction of the advancing individual yarn components. In this process, the control device 12 predetermines a reciprocation algorithm for each group of individual yarn components or each group of traversing yarn guides 9.1–9.3. Thus, for example, the respective desired values can be entered via the input unit 14, which the controller 13 supplies to the linear drives 11.1–11.3. It is thus possible to advance the groups of individual yarn components with different parameters, such as, for example, length of the stroke, number of strokes per minute, and interference pulses. The controller 13, which may be formed, for example, by a stored program system (SPS) permits realizing a synchronous sequence of movements from group to group.

As a result of reciprocating the individual yarn components 19.1–19.9, they form upon advancing onto the withdrawal godet 2, respectively three blended yarns 20.1–20.3 that are guided in a side-by-side relationship. With that, respectively one individual yarn component of a group of traversing yarn guides 9.1–9.3 is associated to each of the blended yarns 20.1–20.3. Thus, the blended yarn 20.1 is formed from individual yarn components 19.1–19.3. The blended yarn 20.2 is formed from individual yarn components 19.4–19.6, etc.

The blended yarns 20.1–20.3 advance over the withdrawal godet 2 and guide roll 3 to draw godet 5 with guide roll 6 by looping them several times. The withdrawal godet 2 and the draw godet 5 are driven by their associated godet drives 4 and 7 at different circumferential speeds, so that the blended yarns 20.1–20.3 undergo a drawing between the withdrawal godet 2 and the draw godet 5. After their drawing, the blended yarns 20.1–20.3 are each compressed in a stuffer box chamber 17.1–17.3 by texturing nozzles 16.1–16.3 to a yarn plug 21.1–21.3. To this end, the blended yarn 20.1 is taken into a yarn channel by the texturing nozzle 16.1 with the use of a conveying medium, and advanced into the stuffer box chamber 17.1 downstream thereof. Accordingly, the blended yarns 20.2 and 20.3 are advanced through the associated texturing nozzles 16.2 and 16.3. In this process, it is preferred to use heated conveying media, such as, for example, hot air, so that while being compressed the filaments of the blended yarns 20.1–20.3 come to lie respectively in loops and coils, so that they undergo a crimping. To stabilize and set the crimp, the compressed yarn plugs 21.1–21.3 advance parallel through a cooling device 18 and undergo a cooling. After cooling, the yarns plugs 21.1–21.3 are each disentangled to form a textured blended yarn 22.1–22.3. Subsequently, the thus produced textured blended yarns 22.1–22.3 are preferably wound to packages. However, it is also possible to subject the textured blended yarns to further treatments, such as, for example drawing, tempering and/or entangling before winding them.

Figure 2:
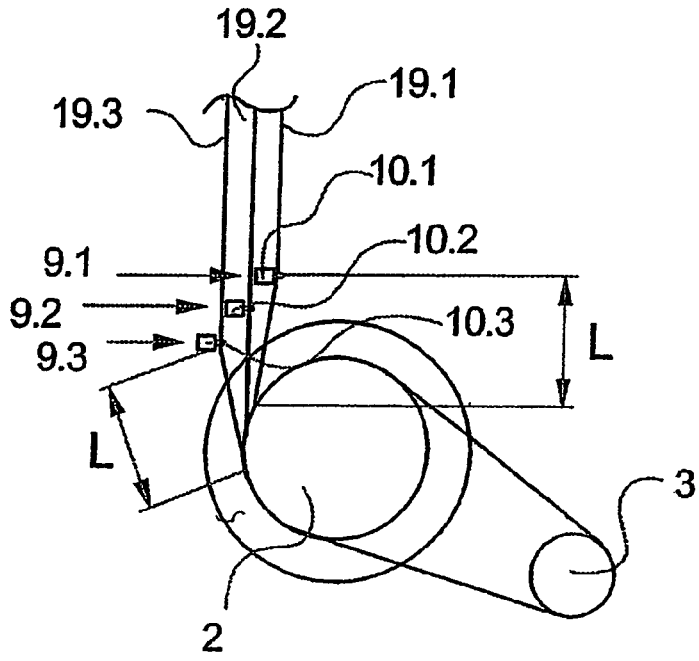
FIG. 2 is a schematic side view of a fragment of the embodiment of FIG. 1.

FIG. 2 schematically illustrates a fragment of the first embodiment according to FIG. 1, which provides for a particularly advantageous arrangement of the guide means 8, and the withdrawal means 1. The Figure is a side view of the groups of traversing yarn guides 9.1–9.3, as well as of the withdrawal godet 2 with the guide roll 3. In the direction of the advancing yarns, the groups of traversing yarn guides 9.1–9.3 are arranged one after the other such that a free yarn length L formed between the respective traversing yarn guides and the points of contact on the circumference of the withdrawal godet 2 is the same for each of the groups of traversing yarns guides 9.1–9.3. Thus, the contact points of the individual yarn components of a blended yarn lie in different angular ranges of the withdrawal godet 2, so as to prevent disadvantageous interferences when reciprocating the individual yarns to blended yarns.

Figure 3:
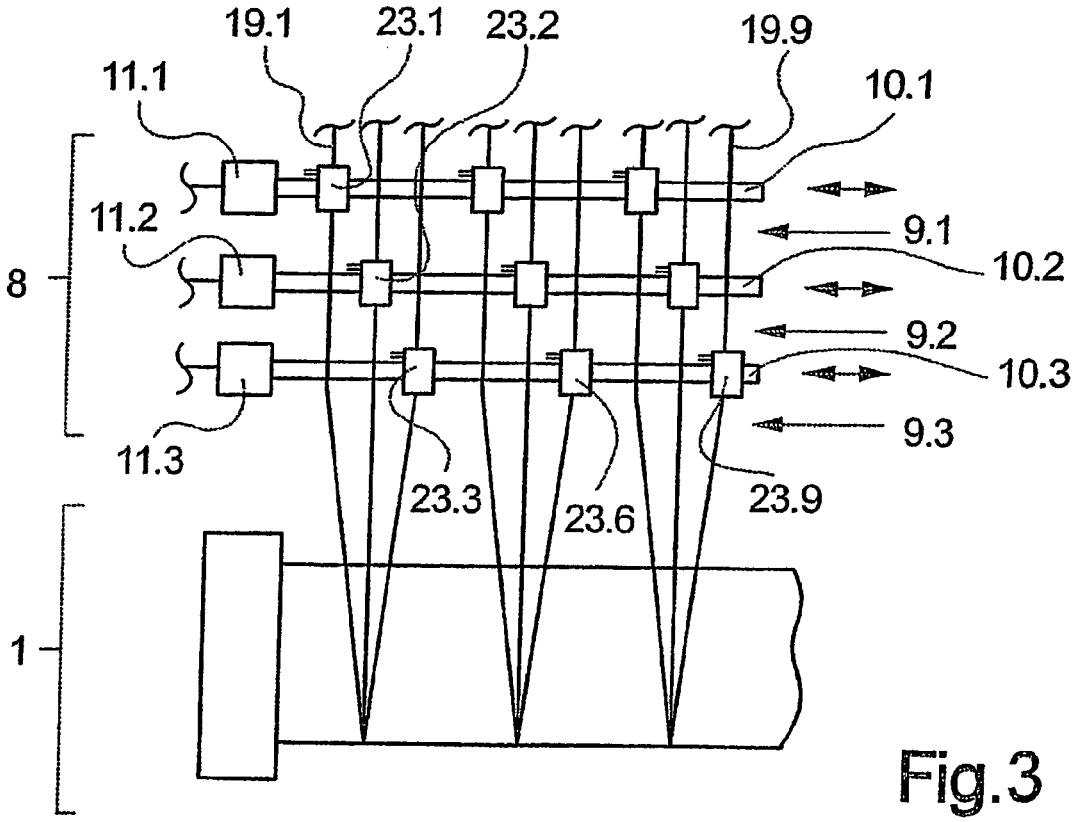
FIG. 3 is a schematic fragmentary view of a further embodiment of the apparatus according to the invention.

FIG. 3 illustrates a fragmentary view of a further embodiment of the apparatus according to the invention. This Figure shows the guide means 8 as well as a portion of the withdrawal means 1. The construction of the withdrawal means 1 is identical with the embodiment of FIG. 1, so that the foregoing description is herewith incorporated by reference. The guide means 8 is largely identical with the foregoing embodiment of FIG. 1, so that at this point only differences are described in greater detail, and that otherwise the foregoing description is herewith incorporated by reference.

In the guide means 8 shown in FIG. 3, the traversing yarn guides are replaced with individual entanglement nozzles 23.1–23.9. The entanglement nozzles 23.1–23.9 are divided into groups and mounted on the guide rods 10.1–10.3. Each of the entanglement nozzles 23.1–23.9 connects to a source of pressure (not shown). In the present embodiment, the reciprocation of the individual yarns is simultaneously combined with an entanglement of the individual yarns. With that, it is possible to achieve special mixing effects to obtain, for example, an intensive blending. In particular, it is thus possible to influence the visual properties of the blended yarns.

The apparatus as well as the method of the invention distinguish themselves by a very great uniformity in the production of parallel blended yarns despite the great flexibility with respect to adjusting defined blending ratios. The synchronous reciprocation of all individual yarn components provides, besides the high uniformity, for an excellent reproducibility in order to produce defined mixed color effects in the case of a plurality of blended yarns. The number of blended yarns can be increased in a simple manner by enlarging the guide means to, for example, six or nine yarns.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for producing a plurality of blended synthetic multifilament yarns, comprising withdrawal means for withdrawing and drawing a plurality of individual multifilament yarn components and combining the yarn components to form a plurality of blended yarns, texturing means for separately texturing each of the blended yarns, and guide means associated with the withdrawal means for laterally reciprocating the individual yarn components, with the guide means comprising a plurality of groups of traversing yarn guides, with each group of traversing yarn guides being driven for reciprocating movement independently of adjacent groups of traversing yarn guides, and with each of the yarn guides of each of the groups of yarn guides being associated with a respective one of the individual yarn components, and wherein each of the individual yarn components per group of yarn guides is respectively associated with one of the blended yarns.

2. The apparatus of claim 1, wherein a group of individual yarn components with the same properties is associated to each group of traversing yarn guides.

3. The apparatus of claim 1, wherein a separate linear drive is associated to each group of traversing yarn guides, and wherein the linear drives are controllable independently of one another.

4. The apparatus of claim 3, wherein the linear drives connect to a control device, which includes an inputting device for entering desired value adjustments with respect to speed, path, and time.

5. The apparatus of claim 3, wherein the traversing yarn guides of one group are mounted on a guide rod in substantially constant spaced relationship, and that one of the linear drives is connected to the guide rod.

6. The apparatus of one of claim 1, wherein the withdrawal means is formed by a plurality of godets with the guide means directly preceding a first godet in the path of the advancing yarns.

7. The apparatus of claim 6, wherein the groups of traversing yarn guides are arranged in the direction of the advancing yarns one following the other at short distances such that the free lengths of the individual yarns formed between the traversing yarn guides and the godet are the same.

8. The apparatus of claim 1, wherein the traversing yarn guides of at least one group of traversing yarn guides comprise a plurality of entanglement nozzles.

9. The apparatus of claim 1, wherein the texturing means for each blended yarn comprises a feed nozzle and a stuffer box chamber interacting with the feed nozzle.

10. A method for producing blended yarns from a plurality of individual yarn components, comprising the steps of dividing the yarn components into a plurality of groups of yarn components, withdrawing the groups of yarn components along parallel paths of travel, reciprocating the yarn components of each group by means of a reciprocating yarn guide which engages each of the yarn components of the group and so that the yarn components of each group reciprocate together, then combining the withdrawn yarn components to form a plurality of blended yarns, with the yarn components of each group of yarn components being respectively associated with each of the blended yarns.

11. The method of claim 10, wherein the yarn components of each of the groups of yarn components have the same properties.

12. The method of claim 11 comprising the further step of texturizing each of the blended yarns.

13. The method of claim 10, wherein the withdrawing step includes drawing the yarn components.

14. The method of claim 13, wherein the reciprocating step is conducted upstream of the withdrawing step.

* * * * *